US010760854B2

(12) United States Patent
Manasek

(10) Patent No.: US 10,760,854 B2
(45) **Date of Patent: *Sep. 1, 2020**

(54) ADJUSTABLE HEAT EXCHANGE APPARATUS AND METHOD OF USE

(71) Applicant: AMERIFAB, INC., Indianapolis, IN (US)

(72) Inventor: Richard J. Manasek, Carmel, IN (US)

(73) Assignee: AMERIFAB, INC., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/719,695

(22) Filed: Sep. 29, 2017

(65) Prior Publication Data

US 2018/0038655 A1 Feb. 8, 2018

Related U.S. Application Data

(63) Continuation of application No. 12/128,493, filed on May 28, 2008, now abandoned.

(Continued)

(51) Int. Cl.

| | |
|---|---|
| ***F28F 1/00*** | (2006.01) |
| ***F28D 7/00*** | (2006.01) |
| ***F27B 3/06*** | (2006.01) |
| ***F27B 3/08*** | (2006.01) |
| ***F27B 3/26*** | (2006.01) |

(Continued)

(52) U.S. Cl.

CPC ..... *F28D 7/0041* (2013.01); *F22B 37/10* (2013.01); *F27B 3/065* (2013.01); *F27B 3/085* (2013.01); *F27B 3/26* (2013.01); *F27D 17/002* (2013.01); *F27D 17/004* (2013.01); *F28D 1/06* (2013.01); *F28F 1/003* (2013.01); *F28F 21/08* (2013.01); *Y10T 428/12292* (2015.01); *Y10T 428/13* (2015.01)

(58) Field of Classification Search

CPC ..... F28D 7/0041; F28D 1/06; F22B 37/10; F27B 3/065; F27B 3/085; F27B 3/26; F27D 17/002; F27D 17/004; F28F 1/003; F28F 21/08

See application file for complete search history.

(56) References Cited

U.S. PATENT DOCUMENTS

| | | | |
|---|---|---|---|
| 60,461 | A | 12/1866 | Bartlett |
| 1,774,150 | A | 8/1930 | Murray |

(Continued)

FOREIGN PATENT DOCUMENTS

| | | | |
|---|---|---|---|
| CN | 2798016 | Y | 7/2006 |
| DE | 3701614 | C2 | 8/1988 |

(Continued)

OTHER PUBLICATIONS

The Riverside Publishing Company; New Riverside University Dictionary; Copyright 1984, 1988, 1994; Cover, Inside Cover, pp. 703 and 969.

(Continued)

*Primary Examiner* — Claire E Rojohn, III

(74) *Attorney, Agent, or Firm* — Taft Stettinius & Hollister LLP; Stephen F. Rost

(57) ABSTRACT

A pipe-within-a-pipe and method of use are provided. The pipe-within-a-pipe comprises a first tube overlaying a second tube. The first tube and the second tube have different structures in some respect.

15 Claims, 11 Drawing Sheets

Related U.S. Application Data

(60) Provisional application No. 60/940,970, filed on May 31, 2007.

(51) Int. Cl.

| | |
|---|---|
| ***F27D 17/00*** | (2006.01) |
| ***F28D 1/06*** | (2006.01) |
| ***F28F 21/08*** | (2006.01) |
| ***F22B 37/10*** | (2006.01) |

(56) References Cited

U.S. PATENT DOCUMENTS

| | | | | |
|---|---|---|---|---|
| 1,844,407 | A | 2/1932 | Murray | |
| 2,239,662 | A | 4/1941 | Bailey | |
| 2,829,972 | A | 4/1958 | Klement | |
| 3,294,162 | A | 12/1966 | Loehlein et al. | |
| 3,706,343 | A | 12/1972 | Saiga et al. | |
| 3,725,056 | A | 4/1973 | Ingerson | |
| 3,849,587 | A | 11/1974 | Hatch et al. | |
| 4,033,561 | A | 7/1977 | Dhelft | |
| 4,054,174 | A | 10/1977 | Haller | |
| 4,097,679 | A | 6/1978 | Fukumoto et al. | |
| 4,122,295 | A | 10/1978 | Nanjyo et al. | |
| 4,135,575 | A | 1/1979 | Gersch | |
| 4,192,258 | A | 3/1980 | Touze | |
| 4,207,060 | A | 6/1980 | Zangs | |
| 4,221,922 | A * | 9/1980 | Okimune | F27D 1/12 110/336 |
| 4,327,899 | A | 5/1982 | Suzuki et al. | |
| 4,337,824 | A | 7/1982 | Kirk | |
| 4,351,055 | A | 9/1982 | Bick et al. | |
| 4,453,253 | A * | 6/1984 | Lauria | F27D 1/12 373/74 |
| 4,455,017 | A | 6/1984 | Wunsche | |
| 4,458,351 | A | 7/1984 | Richards | |
| 4,559,011 | A | 12/1985 | Gritsuk et al. | |
| 4,589,938 | A | 5/1986 | Drosdick | |
| 4,658,761 | A * | 4/1987 | Duggan | C23C 2/26 122/235.14 |
| 4,694,864 | A | 9/1987 | Libin | |
| 4,871,014 | A | 10/1989 | Sulzberger | |
| 4,972,903 | A * | 11/1990 | Kwok | F28D 7/06 165/158 |
| 5,241,559 | A | 8/1993 | Hixenbaugh | |
| 6,059,028 | A | 5/2000 | Kincheloe et al. | |
| 6,330,269 | B1 | 12/2001 | Manasek et al. | |
| 6,334,484 | B1 | 1/2002 | Kandel | |
| 6,563,855 | B1 | 5/2003 | Nishi et al. | |
| 6,890,479 | B2 | 5/2005 | Manasek et al. | |
| 7,895,957 | B2 | 3/2011 | Inomata et al. | |
| 8,089,999 | B2 * | 1/2012 | Manasek | F27D 9/00 373/76 |
| 2004/0194940 | A1 * | 10/2004 | Manasek | C21C 5/4646 165/168 |
| 2007/0277965 | A1 * | 12/2007 | Manasek | F28D 1/06 165/177 |

FOREIGN PATENT DOCUMENTS

| | | | |
|---|---|---|---|
| DE | 8807171 | U1 | 9/1988 |
| DE | 4021250 | A1 | 1/1991 |
| DE | 9103291 | U1 | 11/1991 |
| FR | 2336648 | A1 | 7/1977 |
| GB | 1088827 | A | 10/1967 |
| JP | 55-002558 | A | 1/1980 |
| JP | 60-049840 | A | 3/1985 |
| JP | 61-268956 | A | 11/1986 |
| WO | 0163193 | A1 | 8/2001 |
| WO | 2006111315 | A1 | 10/2006 |

OTHER PUBLICATIONS

Metals Handbook, 8th Edition, vol. 1, Properties and Selection of Metals, Published by American Society for Metals, pp. 960-963, 970, 971, 976, 980, 981, 984-990, 1002, 1033-1037.

European Patent Office; Extended European Search Report issued in connection with European Patent Application No. 08756385.4; dated Dec. 11, 2012.

European Patent Office; Communication pursuant to Article 96(2) EPC issued in connection with European Patent Application No. 01909161.0; dated Nov. 12, 2004.

European Patent Office; Communication pursuant to Article 96(2) and Rule 51(2) EPC issued in connection with European Patent Application No. 01909161.0; dated Jun. 9, 2005.

* cited by examiner

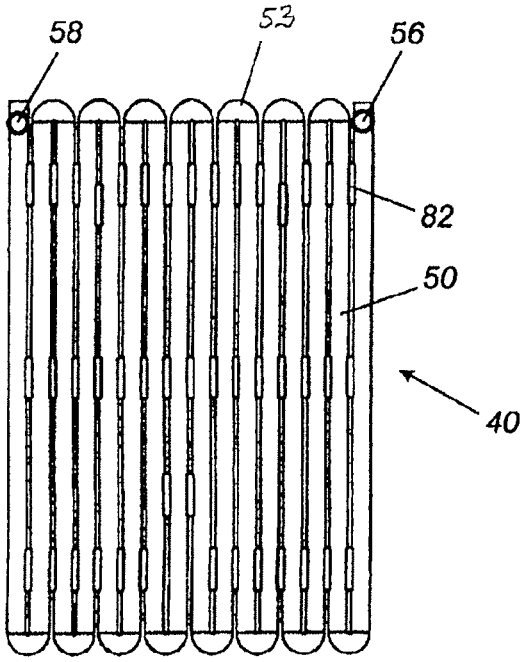
Fig.5
Fig.6
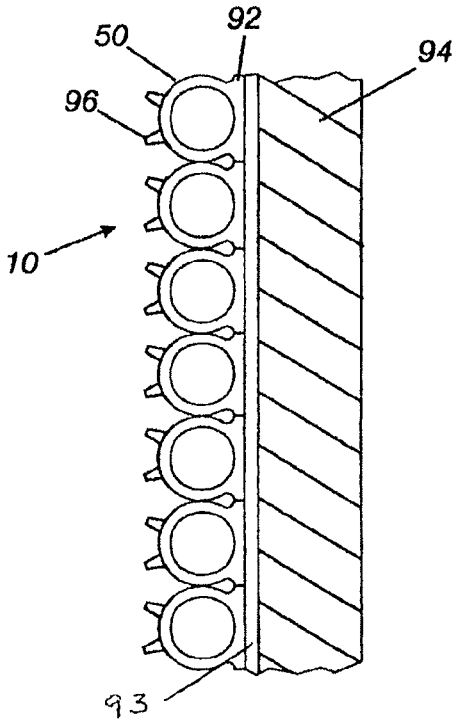
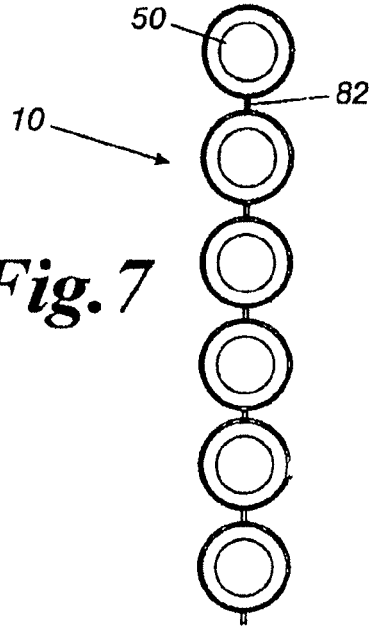
Fig.7

ADJUSTABLE HEAT EXCHANGE APPARATUS AND METHOD OF USE

RELATED APPLICATIONS

This application is a continuation of U.S. patent application Ser. No. 12/128,493, filed May 28, 2008, which claims priority to and the benefit of U.S. Provisional Patent Application No. 60/940,970, filed May 31, 2007, the disclosures of which are now expressly incorporated herein by reference.

FIELD OF THE DISCLOSURE

The present disclosure relates generally to heat exchange devices, and more specifically to heat exchange devices for use in the processing of metals. Such a heat exchange device, for example, may be used in a metallurgical furnace and/or any of its support components as well as in other industries, such as for example the power and chemical industries.

BACKGROUND AND SUMMARY OF THE DISCLOSURE

Industries, including for example the steel, power and chemical industries utilize process equipment that may require one or more water cooled elements to be placed in varying and potentially extreme heat flux conditions with aggressive atmospheres that may for example have high concentrations of acids, particulates and other chemicals that may diminish the operating life of the device. For example, the steel, foundry and metal refining industry has challenges with water cooled and non-water-cooled equipment operating in high mechanical wear, high corrosive, high temperature, high electrically conductive and/or thermally stressing environments within the melting furnace. These extreme and varying conditions make it desirable to have the option to design devices with various materials and operating characteristics with the potential, for example, to optimize the cost/benefit requirements for economic operations.

In the case of steel, for example, steel illustratively is made by melting and refining iron and steel scrap in a metallurgical furnace. Illustratively, the furnace may be an electric arc furnace (EAF) or a basic oxygen furnace (BOF). It is desirable to keep such furnaces operational for as long as possible. One way to extend the operational life of a furnace is to guard against thermal, chemical and mechanical stresses through the use, for example, of heat exchange devices of various and varying designs.

Structural damage caused during the charging process affects the operation of an EAF. Since scrap has a lower effective density than molten steel, the EAF must have sufficient volume to accommodate the scrap and still produce the desired amount of steel. As the scrap melts it forms a hot metal bath in the hearth or smelting area in the lower portion of the furnace. As the volume of steel in the furnace is reduced, however, the free volume in the EAF increases. The vessel wall, cover or roof, duct work, and off-gas chamber are at risk from thermal, chemical, and mechanical stresses caused by charging and melting the scrap and refining the resulting steel. Such stresses may limit the operational life of the furnace. It is desired to protect the portion of the furnace above the hearth or smelting area against the high internal temperatures of the furnace.

Historically, the EAF was generally designed and fabricated as a welded steel structure which was protected against the high temperatures of the furnace by a refractory lining. In the late 1970's and early 1980's, the steel industry began to combat operational stresses by replacing expensive refractory brick with water cooled roof panels, and water cooled sidewall panels located in portions of the furnace vessel above the smelting area. Water cooled components have also been used to line furnace duct work in the off-gas systems. Existing water cooled components are made with various grades and types of plates and pipes. An example of a cooling system is disclosed in U.S. Pat. No. 4,207,060, now incorporated herein by reference, which uses a series of cooling coils. Generally, the coils are formed from adjacent pipe sections with a curved end cap, which forms a path for a liquid coolant flowing through the coils. This coolant is forced through the pipes under pressure to maximize heat transfer. Such pipes and plates have been formed using carbon steel and stainless steel, or more expensive metals such as copper. In this disclosure, the terms tube, tubing, pipes, and piping are synonymous, and may be used interchangeably. In addition, the heat exchangers, as recognized by those skilled in the art, to stabilize operating temperatures.

In some process applications, it is advantageous for a foreign substance such as for example slag, which is a by-product of the melting process, to collect on the operating side ("hot side") or operating portion of the equipment to harness the non-conductive and insulating properties of slag in order to protect the equipment from damage, wear and premature failure during operation. The collected or retained slag also protects against the accidental and potential catastrophic effects of inadvertent splashing of liquid metal against the operating or hot side of the equipment caused by excessive boiling or slopping of the molten metal during the process. A suitable example of cooling pipes designed to encourage slag retention is found in commonly owned U.S. Pat. No. 6,330,269, the disclosure of which is now expressly incorporated herein by reference.

The steel, foundry and metal refining industry also has challenges with water cooled and non-water-cooled equipment collecting unwanted slag and/or other foreign materials on the hot face of the equipment during operation. This slag, siliceous, metallic and/or other foreign materials that enter the process can be detrimental to the operation should it become detached and fall into the liquid steel that is contained within the furnace or duct structure. For example, the accidental intrusion of such material into the molten metal could contaminate or otherwise cause the molten metal in the vessel to become off-specification resulting in its being scrapped or requiring additional high cost processing to refine the molten metal back to its acceptable composition. The dropping of this material into the furnace could also cause excessive boiling or slopping of the molten metal creating a safety hazard in and around the vessel. In addition, the detaching of the foreign materials can be a safety issue should it fall when the equipment is off-line and either damage equipment or hurt workers in the area. Thus, it may be desirable to have heat exchange systems that either encourage or discourage the retention of slag on operating surfaces as desired. One suitable example of such a system is found in commonly owned International Patent Application PCT/US06/060461 of Manasek filed Nov. 1, 2006, the disclosure of which is now expressly incorporated herein by reference. Among other embodiments, PCT/US06/060461 discloses one illustrative embodiment comprising an extruded, drawn or cold rolled tube or pipe that has notches or indentions in its conduction surface to promote the adhesion of slag, siliceous or other foreign materials during normal operations in a metal processing device. A plurality of the illustrative tubes or pipes illustratively may be coupled, butted and/or welded together to form a notched surface that promotes adhesion of slag, siliceous or other foreign material. Another illustrative embodiment comprises an extruded, drawn or cold rolled tube or pipe that has a substantially flat surface configured to deter or resist the adhesion of slag, siliceous or other foreign material during normal operations of a metal processing device, system or equipment. A plurality of the illustrative pipes may be coupled, butted and/or welded together to form a generally smooth planar surface configured to deter or resist the adhesion of slag, siliceous or other foreign material. Illustratively, any combination and configuration of the notched and the generally smooth-surface pipes may be used as appropriate in the various areas of the metal processing device, system or equipment. Methods of use are also claimed.

Today's modern EAF furnaces also incorporate pollution controls to capture the off-gasses that are created during the process of making steel. For example, fumes from the furnace are generally captured in two illustrative ways. Both of these processes are employed during the operation of the furnace. One illustrative form of capturing the off-gasses is through a furnace canopy. The canopy is similar to an oven hood. It is part of the building and catches gasses during charging and tapping. The canopy also catches fugitive emissions that may occur during the melting process. Typically, the canopy is connected to a bag house through a non-water cooled duct. The bag house is comprised of filter bags and several fans that push or pull air and off-gasses through the filter bags to cleanse the air and gas of any pollutants.

The second illustrative form of capturing the off-gas emissions is through the primary furnace line. During the melting cycle of the furnace, a damper illustratively closes the duct to the canopy and opens a duct in the primary line. This is a direct connection to the furnace and is the main method of capturing the emissions of the furnace. The primary line is also used to control the pressure of the furnace. This line is made up of water cooled duct work to guard against temperatures that can reach as high as about 4,000° F. and then drop to ambient in a few seconds. The gas streams generally include various chemical elements, including hydrochloric and sulfuric acids. There are also many solids and sand type particles. The velocity of the gas stream can be upwards of 150 ft./sec. These gasses will be directed to the main bag house for cleansing, as hereinabove described.

The above-described environments place a high level of strain on the water cooled components of the primary ducts of the EAF. The variable temperature ranges in the metallurgy industry can cause expansion and contraction issues in the components which lead to material failure. Moreover, the dust particles continuously erode the surface of the pipe in a manner similar to sand blasting. Acids flowing through the system also increase the attack on the material, additionally decreasing the overall lifespan.

Concerning BOF systems, improvements in BOF refractories and steelmaking methods have extended operational life. However, the operational life is limited by, and related to, the durability of the off-gas system components, particularly the duct work of the off-gas system. With respect to this system, when failure occurs, the system illustratively must be shut down for repair to prevent the release of gas and fumes into the atmosphere. Current failure rates cause an average furnace shut down of 14 days. As with EAF type furnaces, water cooled components have historically been comprised of water cooled carbon steel, or stainless steel type panels.

Using water cooled components in either EAF or BOF type furnaces has reduced refractory costs, and has also enabled steelmakers to operate each furnace for a greater number of heats than was possible without such components. Furthermore, water cooled equipment illustratively has enabled the furnaces to operate at increased levels of power. Consequently, production has increased and furnace availability has become increasingly important. Notwithstanding the benefits of water cooled components, these components have consistent problems illustratively with wear, corrosion, erosion, and other damage. Another problem associated with furnaces is that as available scrap to the furnace has been reduced in quality, more acidic gasses are created. This is generally the result of a higher concentration of plastics in the scrap. These acidic gasses must be evacuated from the furnace to a gas cleaning system so that they may be released into the atmosphere. These gasses illustratively are directed to the off-gas chamber, or gas cleaning system, by a plurality of fume ducts containing water cooled pipes. However, over time, the water cooled components and the fume ducts may give way to acid attack, metal fatigue, or erosion for example. Certain materials, for example, carbon steel and stainless steel, have been utilized in an attempt to resolve the issue of the acid attack. More water and higher water temperatures have been used with carbon steel in an attempt to reduce water concentration in the scrap, and to reduce the risk of acidic dust sticking to the side walls of a furnace. The use of such carbon steel in this manner has proven to be ineffective against acid attack.

Stainless steel has also been tried in various grades. While stainless steel is less prone to acidic attack, it does not possess the heat transfer characteristics or parameters of carbon steel. The results obtained therefore were an elevated off-gas temperature, and built up mechanical stresses that caused certain parts to fracture and break apart.

Breakdowns of one or more of the furnace components may occur in existing furnace systems due to one or more of the illustrative problems set forth above. When such a breakdown occurs, the furnace may need to be taken out of production for unscheduled maintenance to repair the damaged water cooled components. Since molten steel is not being produced by the steel mill during downtime, illustrative opportunity losses of as much as five thousand dollars per minute for the production of certain types of steel can occur. In addition to decreased production, unscheduled interruptions significantly increase operating and maintenance expenses.

In addition to the above described damage or harm to the water cooled components, fume ducts and off gas systems of both EAF and BOF systems are being damaged by corrosion and erosion. Damage to these areas of the furnace also results in loss of productivity and additional maintenance costs for mill operators. Furthermore, water leaks increase the humidity in the off-gasses, and reduce the efficiency of the bag house as the bags become wet and clogged. The accelerated erosion of these areas used to discharge furnace off-gasses illustratively is due to elevated temperatures and gas velocities caused by increased energy in the furnace. The higher gas velocities are due to greater efforts to evacuate all of the fumes for compliance with air emissions regulations. The corrosion of the fume ducts is due to acid formulation/attack on the inside of the duct caused by the meetings of various materials in the furnaces. The prior art teaches of the use of fume duct equipment and other components made of carbon steel or stainless steel. For the same illustrative reasons as stated above, these materials illustratively have proven to provide unsatisfactory and inefficient results. Commonly owned U.S. Pat. No. 6,890,479 to Manasek et al., the disclosure of which is now expressly incorporated herein by reference, as well as commonly owned U.S. patent application Ser. No. 10/828,044 of Manasek et al., the disclosure of which is now expressly incorporated herein by reference, each describe the use of improved heat exchange systems using alternative metal alloys, illustratively aluminum-bronze systems, having enhanced mechanical and physical properties over carbon or stainless steel cooling systems, for example, in that the alloy provides better thermal conductivity, hardness, and modulous of elasticity for the purposes of steel making in a furnace, thereby increasing the operational life of the furnace. However, such an alloy, or the use of other desirable metals, for example and without limitation copper, might cost more (in terms of the cost of the material itself and/or the cost of manufacture suitable for the particular material used) than would carbon or stainless steel.

Historically, then, a plurality of tubes of a uniform material and composition have been used to manufacture the heat exchange systems/water cooled elements described herein above. These tubes or pipes illustratively and generally were steel or some other alloy and had variable cross-sectional areas and internal diameters to meet the specific application requirement(s) or parameter(s) for heat transfer, wear characteristics, coolant velocities and other parameters. As noted, it may be desirable to use some metals or alloys, for example aluminum-bronze alloy, in lieu of others, for example steel in order to achieve desired operating characteristics or parameters. However, as also noted, the costs for tubes and pipes manufactured from such desired alloys, ceramics or other special materials, such as aluminum-bronze alloys for example, can be more expensive relative to using steel or cast iron for example.

A need exists for an improved heat exchange system and method for using same. Specifically, a need exists for an improved method and system wherein water cooled components and/or fume ducts remain operable as long as or longer than existing comparable components through the use of heat exchange systems having selectable operating characteristics or parameters, and selectable methods and materials of manufacture that allow for relatively high performance at relatively low cost.

The present disclosure may comprise one or more of the features identified in the various claims appended to this application and combinations of such features, as well as one or more of the following features and combinations thereof.

Provided is a pipe comprising:

an inner tube defined by a first inner boundary and a first outer boundary, the first inner boundary defining a hollow core having a core center; and an outer tube overlaying the inner tube, the outer tube defined by a second inner boundary and a second outer boundary, the second inner boundary overlaying the first outer boundary;

wherein the composition or structure of the inner tube and the composition or structure of the outer tube differ in some respect relative to one another.

Also provided is a method of cooling an interior portion of a furnace comprising the steps of:

providing a pipe comprising:

an inner tube and an outer tube overlaying the inner tube;

equipping a piece of equipment with the pipe; and directing a cooling fluid through the tubular section.

The pipe may be coupled with a mounting member, such as for example and without limitation a plate. Another illustrative mounting member includes a bracket. The plate may be coupled together with the piece of equipment, which may be for example and without limitation a furnace.

The following materials have generally and illustratively been available for use in the pipes of heat exchange or protective systems: steel, cast iron, extruded steel, stainless steel, nickel alloys, copper, aluminum-bronze alloys, etc. The present disclosure will allow any desired combination of the above, or any other desirable metal, or other material including composites, to be used alone or in combination. For example, an inner tube may comprise a suitable, though relatively inexpensive material or metal such as for example and without limitation steel, suitable for transporting a liquid coolant. This inner tube may be overlaid or clad with a special/selected outer material, tube or pipe comprising a different, illustratively perhaps more expensive, material, such as for example and without limitation an aluminum-bronze alloy, with better operating characteristics or parameters relative to the inner tube material in the particular environment of operation. Illustratively, the outer layer or cladding may be produced by extruding a cladding tube/pipe onto the pipe/tube that forms the inside portion of the clad pipe. It will be appreciated that the outer material may be more expensive relative to the inner material or vice versa. So, too, the outer and inner material may be different grades or formulations of the same or similar material. In any event, it will also be appreciated that the outer material may have performance characteristics optimized for the environment in which it operates. It is also the case that the inner tube material may have better operating characteristics in the regime in which it operates (for example fluid transport), and may be more or less expensive than the outer material. In any event, the inner tube may have one or more characteristics or parameters that differ from those of the outer tube. Each of the inner and outer tube may have a differing construction or structure, for example and without limitation by varying the shape, cross-section, and/or materials of the respective inner and outer tubes, in order to emphasize one or more characteristics or parameters. The emphasis may seek, but need not seek to optimize the particular characteristic or parameter. Thus, the special clad tube/pipe illustratively will result in having the same or similar physical, abrasiveness resistance, chemical attack resistance, heat transfer, thermal attributes or other characteristics/parameters of a tube/pipe manufactured from 100% of the selected material except that the clad tube illustratively may have a lower overall cost, which itself may be a selected characteristic or parameter, and/or have better operating characteristics/parameters in one or more regimes. In the alternative, the outer and inner materials may be combined based on their different operating characteristics being optimized relative to one another for the regimes in which they operate. Therefore, illustratively in the case of a heat exchange or protective device incorporating pipes with an outer cladding of aluminum-bronze alloy, it will have a higher, relative to a steel pipe, thermal conductivity, resistance to etching by the stream of hot gasses (modulus of elasticity), and good resistance to oxidation, thereby increasing the life of the heat exchange system through reduced corrosion and erosion of the heat exchange system and related components. The combination of outer and inner materials may be necessary due to the need to have a pipe wall of a certain thickness, for example the heavy-walled pipes needed for use in portions of an EAF, without having to have the inner portions of that thickness comprised of a high-priced material. Similarly, as noted, the combination of materials could be selected to obtain optimum operating characteristics in different regimes. For example, the inner material could be selected to optimize the desired operating characteristics, for example fluid flow rate, in that regime, or to provide for the cost effectiveness, or some combination thereof; while the outer cladding is selected to better withstand the hot-side stresses relative to the material of the inner pipe or tube.

The disclosure illustratively will allow a wider flexibility and application of materials of construction that will improve equipment longevity plus on-line reliability and up-time because the equipment will be better suited to resist the effects of the high heat flux, corrosive and abrasive atmosphere in the furnaces, combustion chambers, flue gas systems, etc. equipment that are comprised of an assembly of such elements and at a potential cost savings.

It is anticipated that the present disclosure can be used in combination with other heat transfer equipment, such as condensers, shell and tube-type exchangers, finned exchangers, plate-and-frame-heat exchangers, and forced-draft air-cooled exchangers. In addition, it is anticipated that such other heat transfer equipment could itself benefit from using a combination of materials in accordance with the current disclosure. It is further anticipated that the current disclosure and any heat exchange system incorporating the present disclosure has other applications, such as cooling exhaust gasses from converting plants, paper manufacturing plants, coal and gas fired electrical power generation plants, and other exhaust gas generators, where the gasses are cooled for the purpose of capturing one or more components of the gas, where capture is effected by condensation, by carbon bed absorption, or by filtration.

Illustratively, the pipes can be cold rolled, hot rolled, drawn, extruded or cast. The pipes can be manufactured from ferrous metals, steel, copper, steel/ferrous alloy or copper alloys, nickel, titanium, bronze alloys including aluminum-bronze and nickel-bronze alloy alloys, and other suitable materials. The pipes can be seamless or welded in design as desired.

In summary, the disclosure illustratively will create a means to select a wider range of materials, operating characteristics and costs for manufacture of customer shaped and designed water cooled elements for steel, chemical. power and perhaps other industry applications. The elements will have the ability to better withstand the hostile and ever changing requirements in the furnaces, flue gas systems, off gas hoods, skirts, combustion chambers, drop out boxes etc. due to the inherent and improved coolant velocity within the element and the resulting increased heat transfer capability. This disclosure allows the selection of cladding materials that can be extruded onto an internal tube/pipe of different material at a required or desired cross-sectional radius to potentially optimize the operating characteristics in one or more regimes, for example heat transfer and elasticity requirements of the application, as desired and without limitation to current requirements to select the tube/pipe from generally uniform materials that are available on the commercial market.

These and other benefits and uses of the present disclosure will become more apparent from the following description of the illustrative embodiment.

BRIEF DESCRIPTION OF THE DRAWINGS

FIG. 5 is a side view of a panel of sinuously winding piping with an inlet and an outlet. The piping is spaced and linked with brazed linkages and may comprise differing inner and outer materials.

FIG. 6 is a cross-sectional view of the sinuously winding piping according to the disclosure, wherein the piping has illustrative splines and a base. The base illustratively is attached to a base plate that is attached to an interior side of a wall.

FIG. 7 is a cross-sectional view of the sinuously winding piping according to the disclosure, illustrating how the pipes may be spaced and linked with connecting linkages.

DETAILED DESCRIPTION

Figure 1:
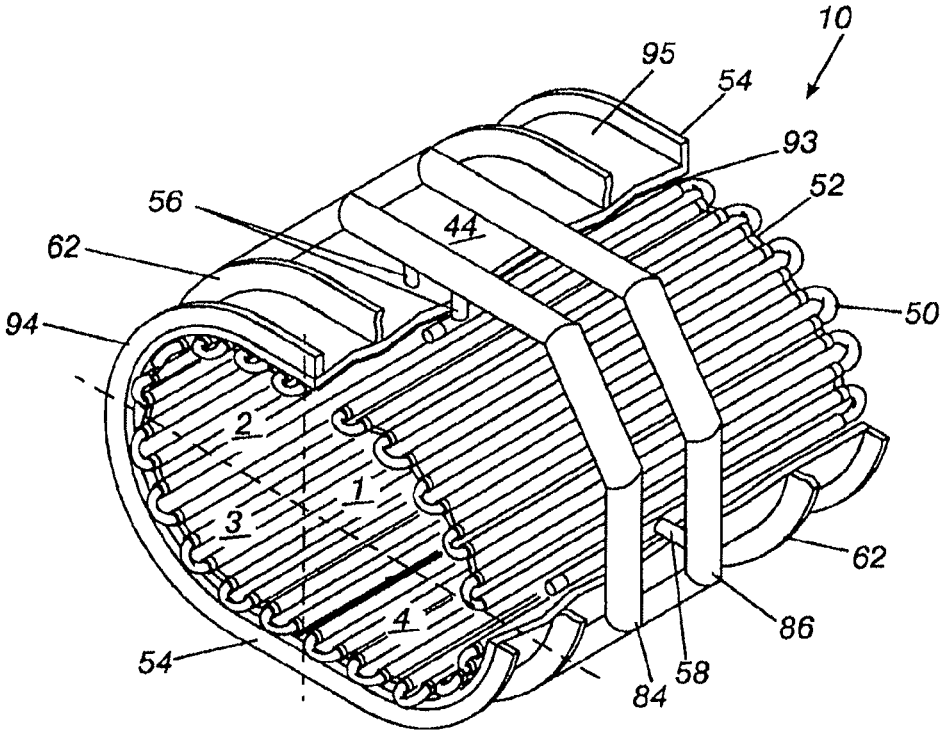
FIG. 1 is a partially cut away perspective view illustrating a heat exchange system having at least one panel of sinuously winding piping which illustratively may be mounted on the inside of a furnace exhaust duct and which illustratively may have pipes having one material, for example aluminum-bronze, overlaying another material for example steel.
Figure 1A:
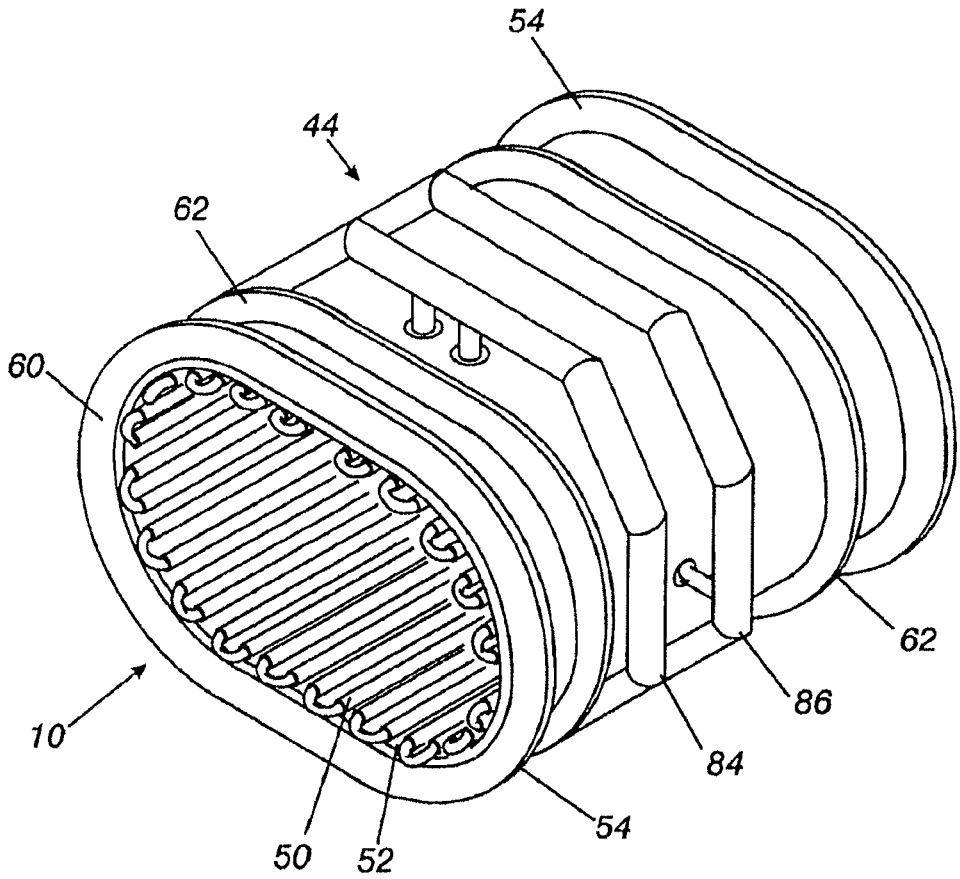
FIG. 1*a* is a perspective view of the heat exchange system illustrated in FIG. 1.

For the purposes of promoting an understanding of the principles of the disclosure, reference will now be made to a number of illustrative embodiments illustrated in the drawings and specific language will be used to describe the same. It is to be understood that the disclosed embodiments are merely exemplary of the disclosure, which may be embodied in various forms. Therefore, specific structural and functional details disclosed herein are not to be interpreted as limiting.

Figure 13:
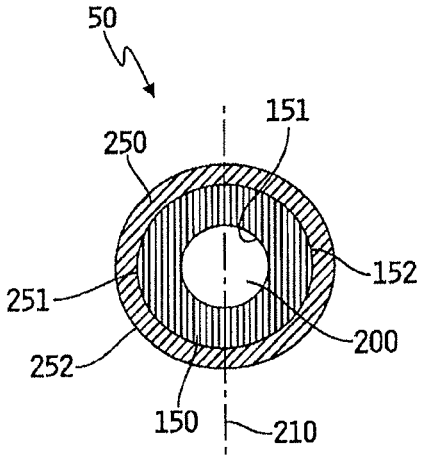
FIG. 13 is a cross-sectional view of an illustrative pipe showing the inner and outer portions.

Referring to FIG. 13, an illustrative heat exchange system 10 comprising an exemplary pipe 50 is depicted. The illustrative heat exchange system 10 comprises a pipe 50 having an inner material and an outer material. Illustratively, the inner material comprises an inner tube 150 and the outer material comprises an outer tube 250. The inner and outer tubes or portions 150, 250 have compositions or structures that illustratively differ in one or more respects from each other. For example, and without limitation, they may have different dimensions, they may be manufactured from differing materials, including differing grades of the same material, they may be manufactured from differing processes, and the like.

The inner tube 150 illustratively is defined by a first inner boundary 151 and a first outer boundary 152. The first inner boundary 151 and the first outer boundary 152 comprise or define the wall of the inner tube 150 and bound or define a hollow core 200 having a central axis 210 running generally through the center and along the longitudinal length of the inner tube 150. The pipe 50 further comprises the outer tube 250 defined by a second inner boundary 251 and a second outer boundary 252. The outer tube 250 overlays the inner tube 150. Illustratively, when the outer tube 250 overlays the inner tube 150, the central axis 210 runs generally through the center of and along the length of the outer tube 250. In other words, the pipe and the inner and outer tubes 150, 250 illustratively are concentric, illustratively sharing or having the same coincident centers and central axis 210. The inner and outer tubes may be of different composition or structure from one another The outer tube 250 illustratively may be formed, cast or extruded onto the inner tube 150. Other methods of manufacture suitable to the particular material may be used. For example, the outer tube 250, could be welded onto the inner tube 150. In another illustrative example of a suitable method of manufacture the inner and outer tubes 150, 250 could be formed into a unitary pipe 50. Further illustratively, the cladding 250 could be bonded to the inner material or tube 150 by for example and without limitation heat, pressure, extrusion, or casting. In any event, the inner tube 150 could be clad or overlaid with a metal coating 250 of a different composition. The cladding 250, for example and without limitation could be selected to exploit, for example by imparting, emphasizing, promoting, minimizing, or optimizing some desired property, characteristic or parameter such as for example conductivity, or the resistance of corrosion, erosion, pressure, thermal stress or the like. The inner tube 150 could be fashioned to exploit, for example by imparting, emphasizing, promoting, or optimizing the same or a different desired property compared to the cladding. For example, the inner material 150 could be selected to optimize fluid flow, heat transfer, malleability, longevity, material cost, manufacturing process or the like.

As noted, the clad 150 and cladding 250 material(s) may be selected to satisfy desired operating characteristics or parameters or other application requirements, including for example and without limitation economic requirements. Illustratively, the inner tube may but need not be made from a material having a lower cost compared to the cost of the cladding material. Illustratively, the cross-sectional area and outer cladding configuration may be adjusted to meet the resulting coolant velocity, pressure drop and residence time in the device required to optimize the operating device of the device. The entire length of the cladding material illustratively may have a generally consistent geometry throughout its length. For example, the outer surface illustratively could be smooth or could incorporate geometries required for the application. For example, the outer surface could include slag retention devices or indentations or webs or protrusions for mounting the pipe 50 to one or more other pipes 50, and/or to a mounting member or plate 93 or directly to a device such as an EAF or portion thereof. The outer configuration of the cladding tube can also be designed to have wings or other protrusions to allow a plurality of pipes to be connected together, as for example by welding if desired.

It will be appreciated that the clad 150 and cladding 250 tubes could comprise half tubes or pipes of the kind disclosed, for example and without limitation, in U.S. patent application Ser. No. 11/741,769, filed Apr. 30, 2007, the disclosure of which is now expressly incorporated herein by reference. Illustratively, only one or the other of the tubes 150, 250 could have a half-pipe or semi-circular construction. A plurality of such illustrative half tube/pipe elements could illustratively be welded onto a mounting member or flat plate. The welding illustratively for example and without limitation will be along the length of the half tube/pipe elements. In the event a winged design half tube is used a single weld could attach two adjacent tube(s)/pipe(s) together. The clad tube(s)/pipe(s) will be connected to comprise a closed loop coolant circuit by either having 180 degree half elbows, or mitered elbows or supply and return headers. In the event that the resulting water cooled element requires a radius to be used in the apparatus (e.g. water cooled duct or water cooled elements for arc furnace sidewalls) the entire element can be designed to be rolled in a typical plate roll to the desired radius in a specially modified plate roll. It will be appreciated that the total thickness of the element can be decreased when compared to typical tube/pipe design elements. This will effectively increase the working volume of the apparatus. This disclosure will offer a more cost competitive material of manufacture for complex heat exchanging devices for steel, chemical and power industry, as well as other industry applications.

It will be appreciated that the illustrative pipes illustratively having an outer material or cladding that differs from an inner material. Such pipes may be used in numerous types of heat exchange systems for use in numerous types of heat exchanger applications in numerous industries. One such illustrative use in one such illustrative heat exchange system will now be described, it being understood that the pipe(s) described in the illustrative heat exchange system illustratively are constructed or formed illustratively having an outer tube/material that differs from an inner tube/material.

Illustratively, the outer tube cladding material, which may be selected based on the application requirement, will be formed, cast or extruded onto an inner tube, which may have one or more characteristics, for example a low cost compared to the cladding material, that differ(s) from those of the cladding material. The cross-sectional area and/or the outer cladding configuration illustratively may be adjusted to meet the resulting coolant velocity, pressure drop and/or residence time in the device required to optimize the operating life of the device.

The entire length of the cladding material may have a consistent geometry throughout its length. The outer surface of the cladding could be smooth, or could incorporate other geometries required for a particular application such as for example and without limitation slag retention devices, such as for example and without limitation fin 96, anti-slag devices, or indentations or webs to facilitate welding a plurality of pipes together.

The outer configuration of the cladding tube/pipe can also be designed to have extensions or wings to allow the plurality of tubes to be welded together.

The plurality of half tube/pipe elements described herein above illustratively may be attached to the device, such as a furnace, or may be attached, for example and without limitation by welding, to a plate, which in turn may be mounted within the device. The welding illustratively may be along the length of the half tube/pipe elements.

In the event a winged design half tube is used a single weld illustratively may be used to attach two adjacent tube(s)/pipe(s) together.

The clad tube/pipes illustratively may be connected together in fluid communication to comprise a closed loop coolant circuit by using for example and without limitation 180 degree half elbows, or mitered elbows or supply and return headers.

In the event that the resulting water cooled element requires a radius to be used in the apparatus (e.g. water cooled duct or water cooled elements for arc furnace sidewalls) the entire element can be designed to be rolled in a typical plate roll to the desired radius in a specially modified plate roll.

A secondary advantage to the design is that the total thickness of the element may be decreased when compared to typical tube/pipe design elements. This is advantageous in steelmaking process equipment because this will effectively increase the working volume of the apparatus.

This disclosure will offer a more cost competitive material of manufacture for complex heat exchanging devices for steel, process and power industry applications. It will be appreciated that the illustrative embodiments described above and illustrated in FIG. 13 may be applied to numerous heat exchange configurations and elements, as well as used with other compositions as further described herein below.

Referring to FIGS. 1-12, other configurations and compositions are contemplated. For example, the heat exchange system or heat exchanger 10 comprises at least one panel of sinuously winding piping 50 having an inlet 56 and an outlet 58, an input manifold 84 in fluid communication with the inlet of the at least one panel, an output manifold 86 in fluid communication with the outlet of the at least one panel, and a cooling fluid flowing through the piping. The piping 50 described herein illustratively may comprise piping having an inner tube and an outer tube or cladding as described herein. The heat exchanger system 10 cools hot fume gasses 36 and dust that is being evacuated from a metallurgical furnace 80 and its supporting components. The piping is an assemblage of sectional lengths of connected tubes mounted side-by-side, wherein the connected tubes are secured to each other with a linkage 82, therein forming the at least one panel 50. It has been determined that one illustrative and desirable composition for fabricating the piping 50 is an aluminum bronze alloy. Aluminum bronze alloys have been found to have a higher than expected thermal conductivity, resistance to etching by the stream of hot gasses (modulus of elasticity), and good resistance to oxidation. Thus, the operational life of the heat exchanger is extended. Corrosion and erosion of the heat exchanger and related components is reduced, when they are fabricated with aluminum bronze. Aluminum bronze has thermal conductivity that is 41% A higher than P22 (Fe.about.96%, C.about.0.1%, Mn.about.0.45%, Cr.about.2.65%, Mo.about.0.93%) and 30.4% than carbon steel (A106B). The heat exchangers fabricated using aluminum bronze and alloys thereof are more efficient, and have a longer operational life than furnace constructed of refractive materials and or other metal alloys.

It has also been determined that the piping illustratively may be extruded, and that extruding may help the piping resist corrosion, erosion, pressure, and thermal stress. Depending on the application, performance may be enhanced where the piping has an elongate ridge that serves as a fin or spline 96. The fin can serve to enhance cooling and collect slag. If the piping is extruded, there are no weld lines associated with the fins that can fail, and the extruded seamless piping distributes heat more uniformly, which in turn improves the overall performance of the heat exchanger system. The piping can be curved or bent to match the curvature of a wall to which it is being attached, if so needed. More typically, the individual sections of piping are secured to each other with an angled linkage such that the resulting panel has a curvature that is comparable to the curvature of the wall.

The heat exchanger system as illustrated in the drawings (FIGS. 1-12) employs manifolds and multiple panels to further enhance the cooling efficiency. The combination assures that cool water is flowing through all the piping, therein optimizing heat transfer. The sinuously winding piping optimizes the surface area. The piping is typically secured using linkages and spacers, which enable fume gasses to flow essentially around nearly the entire perimeter of the piping.

Referring to FIG. 1, an illustrative heat exchanger 10 is shown in a fumed exhaust gas duct 44 having a wall 94 with an interior side of the wall 93 and an exterior side of the wall 95. The wall 94 is partially cut away to view the interior of the duct 44. The illustrated duct 44 is elliptical, an engineering construction selected to increase the surface area versus a circular duct. The duct is divided into four quadrants, numbered 1-4, as indicated by the abscissas and the ordinate dashed lines. In the instant disclosure, the heat exchanger utilizes four panels of sinuously winding piping, each with one inlet 56, and one outlet 58. Each panel is assembled with linkages 52 that serve as spaces and fasteners to secure the pipes 50, and therein establishing the relative position of one sectional length of piping with respect to the adjacent sectional lengths of piping. The panels, 1-4, are mounted on the inside wall 93 of the duct 44. Each panel is in fluid communication with an input manifold 84, and an output manifold 86. The manifolds 84 and 86 are mounted to the exterior side 95 of the wall 94, and substantially encircle the duct 44. The piping 50 is oriented so as to be substantially collinear with the wall of the duct 44. The orientation is selected because it is easier to fabricate and creates less pressure drop over the length of the duct. Both ends of the duct 44 are terminated with a flange 54 that enables the cooling duct to be coupled to another duct. Each duct is substantially a self-contained modular cooling unit. The modularization enables duct fabrication to be to a certain extent generic. Each duct has a cooling capacity, and the ducts are combined in sufficient numbers to achieve the desired cooling. The modularization is in part due to the fact that the heat exchanger system is comprised of individually cooled panels having a known cooling capacity, that when combined determine the cooling capacity of the duct. The cumulative cooling capacity is ultimately, therefore, a function of the type, number, and configuration of the panels, and the temperature and flow rate of the cooling fluid provided by the manifolds. The panels are largely substantially self-contained, modular components that are also relatively generic. The fume exhaust duct 44 typically has a pair of mounting supports numbered 62 for attaching the duct to a frame or support.

Figure 1C:
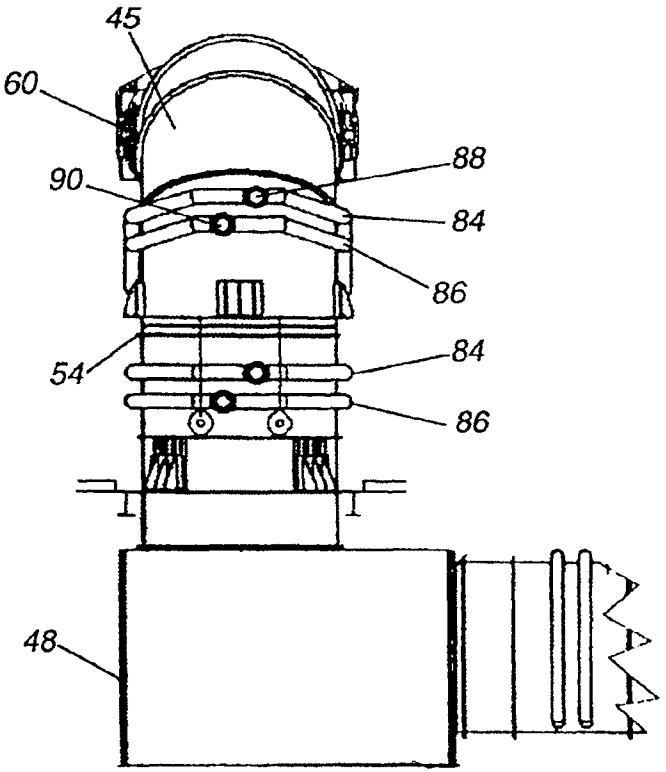
FIG. 1*c* is an elevational view of the ducts and the off-gas chamber illustrated in FIG. 1*b*.
Figure 1B:
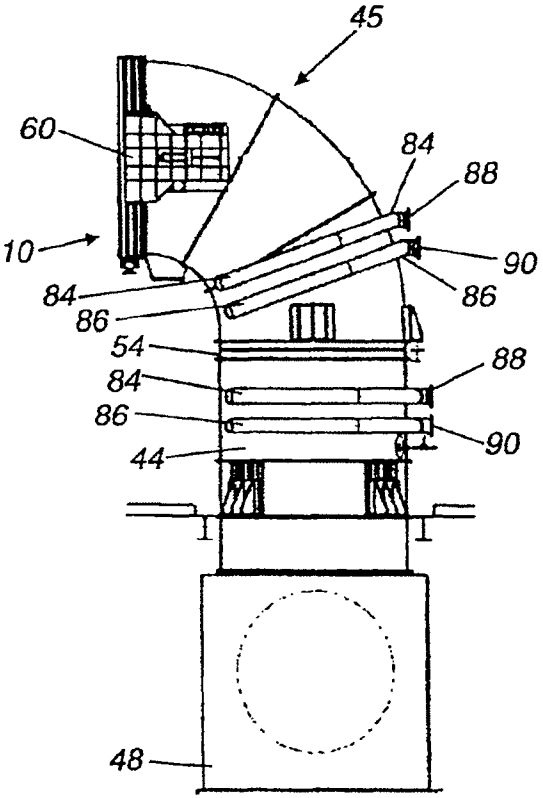
FIG. 1*b* is a side view of an elbow exhaust duct connected to a straight exhaust duct, which in turn is connected to an off-gas chamber.
Figure 1D:
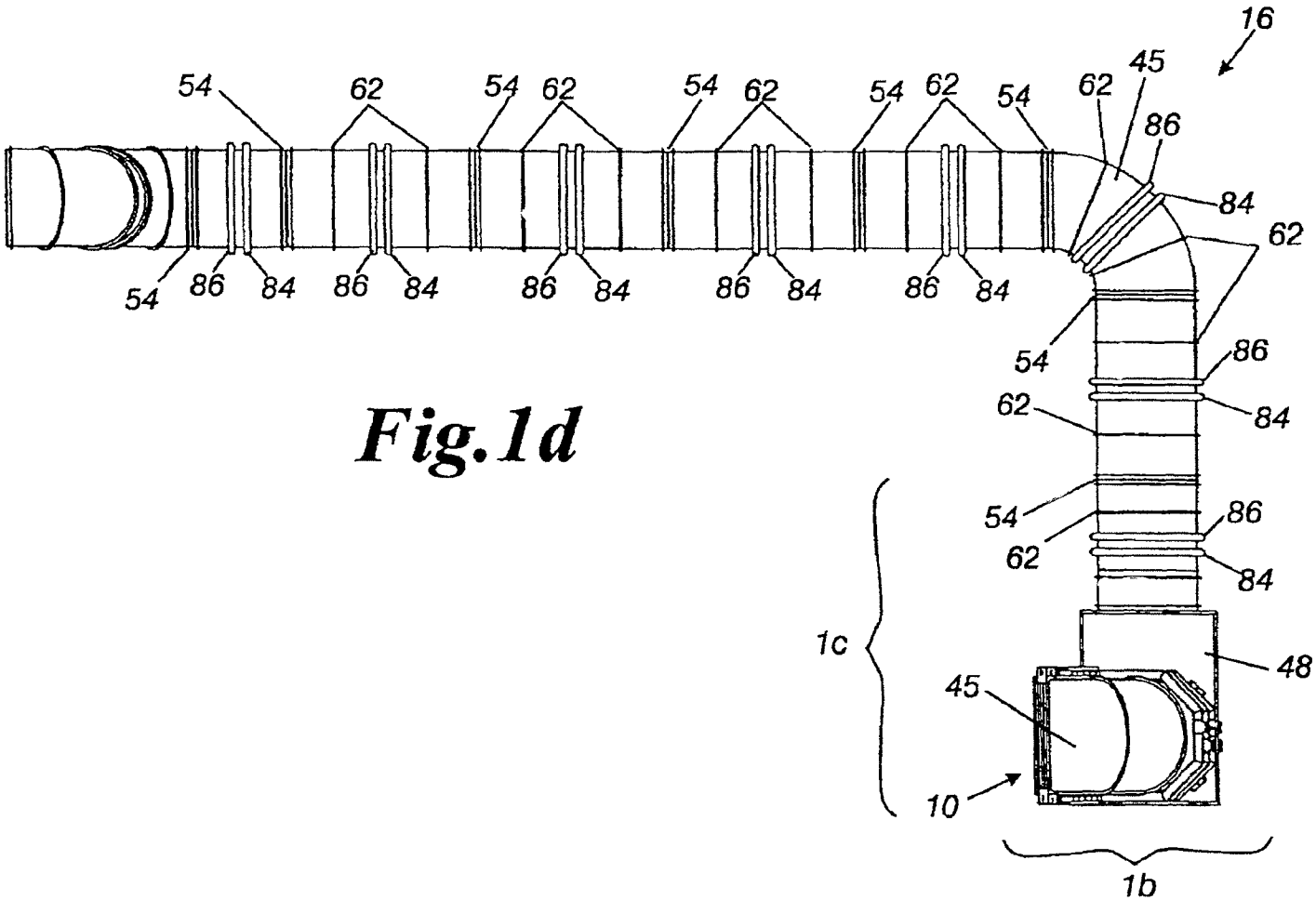
FIG. 1*d* is an offset elevational view of a series of cooling exhaust ducts. The series of cooling exhaust ducts are connected to the off-gas chamber, and the elbow exhaust duct that is connected to a roof of the furnace. The series provides both cooling and ducting of the hot fume gasses and dust being drawn off the furnace.

The external elements of the duct and the heat exchanger system are illustrated in FIGS. 1*a*, 1*b*, 1*c*, and 1*d*. The duct 44 can be fitted with mounting member(s) or bracket(s) 60 for attaching the duct to the furnace roof, to an off-gas chamber (which is sometimes referred to as an air box 48), or to provide support to the flange 54. Referring to FIG. 1*b*, the elbow duct 45 is connected to a straight exhaust duct 44, which in turn is connected to an off-gas chamber 48. The elbow shaped duct 45 has roof brackets 60 for securing the elbow 45 to a furnace roof. A smoke ring 66 protrudes from the entrance of the elbow duct 66. As can be seen in FIGS. 2-4 and FIG. 8, the smoke ring 66 is the heat exchanger 10 having a circular configuration. The elbow duct has an input manifold 84 and an output manifold 86. The input manifold 84 is connected to a source of cooling water at 88 and the output manifold 86 is connected to a recycle outlet 90. The elbow duct 45 and the straight duct 44 are coupled via their respective flanges 54. The straight duct 44 and the off-gas chamber 48 are coupled via their respective flanges 54. The off-gas chamber 48 preferably has a pressure release mechanism on the off chance that an explosion develops in the furnace. The off-gas chamber 48 also serves as a junction box if additional capacity is required at a later date. Referring to FIG. 1*c*, the partially cooled fume gasses coming off the furnace are diverted 90 degrees to the remainder of the exhaust system 16. The length of the system is sufficient to cool the exhaust gasses exiting a metallurgical furnace, such as EAF or BOF from 4,000.degree. F.-5,000.degree. F. to 200.degree. F.-350.degree. F. As shown in FIG. 1*d*, the complete cooling system outside the furnace is comprised of 8 pairs of manifolds after the off-gas chamber 48, plus 2 pairs prior to the off-gas chamber 48, and a smoke ring. Each pair of manifolds has 4 heat exchanger panels, bringing the total number to 40 panels, plus the smoke ring panel 66. The smoke ring can be mounted on the roof of the furnace, instead of to a duct, and a discussion of this configuration follows.

Figure 2:
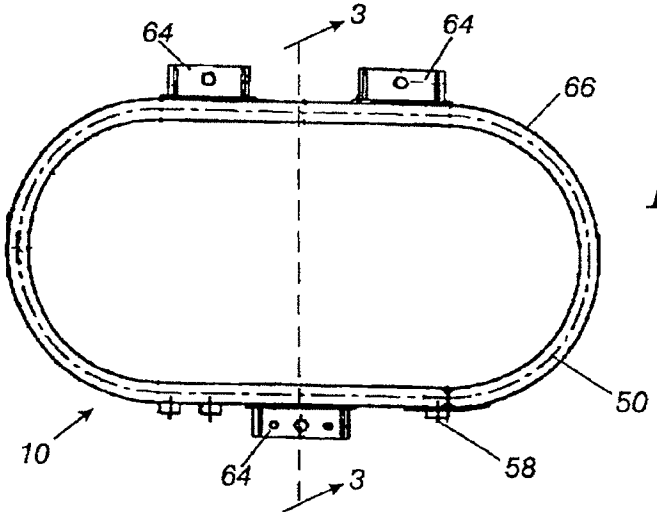
FIG. 2 is a planar view of the heat exchange system configured as a smoke ring, where the smoke ring is comprised of sinuously winding piping that winds back and forth forming a curved panel that is an ellipsoidal ring. The pipe may comprise differing inner and outer materials. The ellipsoidal ring has one inlet and one outlet for the cooling water. Alternatively, the smoke ring can be configured to have more than one inlet and outlet.
Figure 3:
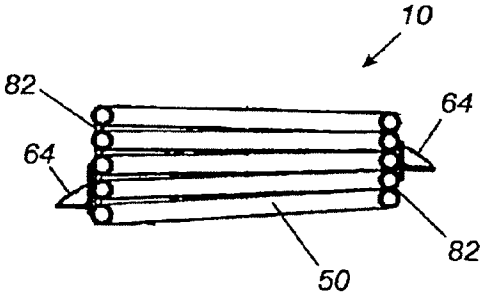
FIG. 3 is a cross-sectional view of the disclosure illustrated in FIG. 2 taken along sectional line 3-3.
Figure 4:
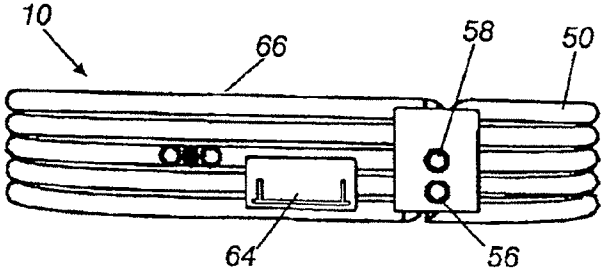
FIG. 4 is a side view of the heat exchange system configured as a smoke ring illustrated in FIG. 2.

Referring to FIGS. 2-4, which further illustrate the heat exchanger system configured as a smoke ring, where the smoke ring 66 is comprised of sinuously winding piping that winds back and forth forming a curved panel that is an ellipsoidal ring. The ellipsoidal ring has one inlet and one outlet for the cooling water. Alternatively, the smoke ring can be configured to have more than one inlet and outlet. In the embodiment shown, the heat exchanger 10 has three smoke ring brackets 64 for mounting the heat exchanger to a domed furnace roof. The piping 50, as shown in FIG. 3, is more compressed on the right than on the left, and the bracket 64 on the left is lower on the left than on the right. The compression and the different placement of the bracket compensates for the pitch of the roof, which result in a profile that is substantially vertical. The linkages 82 establish not only the curvature of the panel of sinuously winding piping 50, but also the profile.

Figure 8:
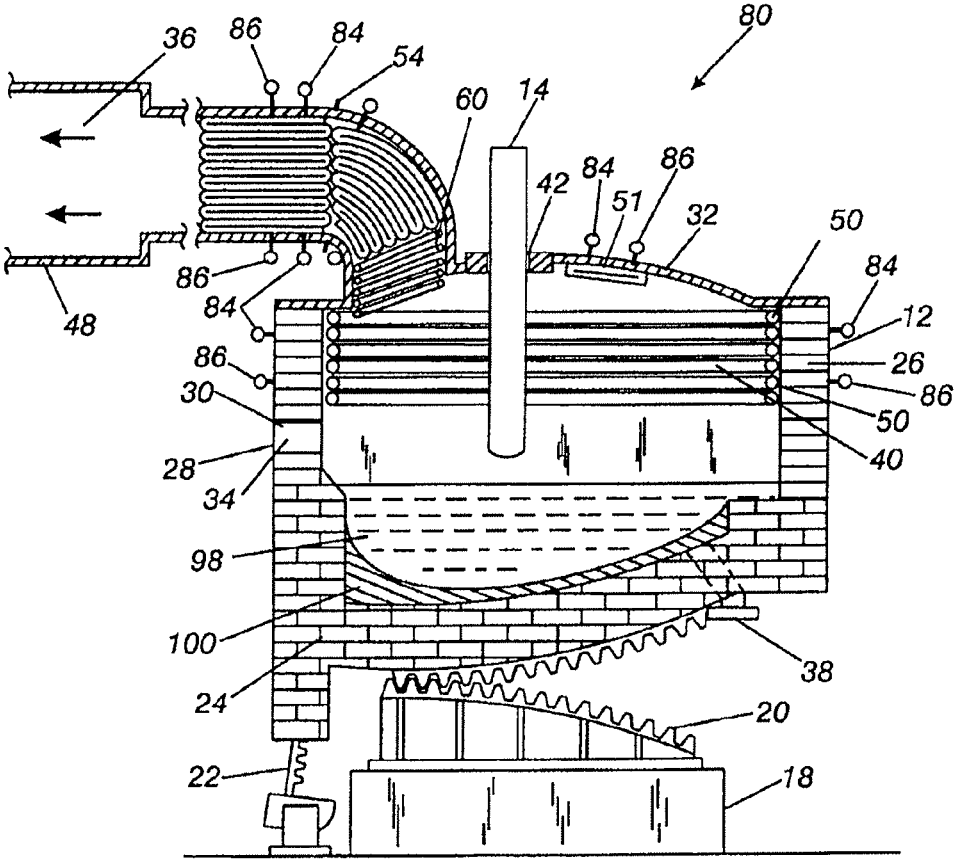
FIG. 8 is a cross-sectional view of a steel making furnace fitted with numerous components of the heat exchange system including pipes having an outer material that differs from the inner material. The system illustratively is used in the furnace as well as in the ducts to cool the exhaust gasses.

Referring to FIG. 8, the illustrative furnace is shown as an EAF type furnace 80. It is to be understood that the EAF disclosed is for explanation only and that the disclosure can be readily applied in BOF type furnaces and the like. In FIG. 8, an EAF 80 includes a furnace shell 12, a plurality of electrodes 14, an exhaust system 16, a working platform 18, a rocker tilting mechanism 20, a tilt cylinder 22, and an off gas chamber b. The furnace shell 12 is movably disposed upon the rocker tilt 20 or other tilting mechanism. Further, the rocker tilt 20 is powered by tilt cylinder 22. The rocker tilt 20 is further secured upon the working platform 18.

The furnace shell 12 is comprised of a dished hearth 24, a generally cylindrical side wall 26, a spout 28, a spout door 30, and a general cylindrical circular roof 32. The spout 28 and spout door 30 are located on one side of the cylindrical side wall 26. In the open position, the spout 28 allows intruding air 34 to enter the hearth 24 and partially burn gasses 36 produced from smelting. The hearth 24 is formed of suitable refractory material which is known in the art. At one end of the hearth 24 is a pouring box having a tap means 38 at its lower end. During a melting operation, the tap means 38 is closed by a refractory plug, or a slidable gate. Thereafter, the furnace shell 12 is tilted, the tap means 38 is unplugged, or open and molten metal is poured into a teeming ladle, tundish, or other device, as desired.

The inside wall 26 of the furnace shell 12 is fitted with water cooled panels 40 of sinuously winding piping 50. The panels, in effect serve as an interior wall in the furnace 80. The manifolds, which supply cool water and a return, are in fluid communication with the panels 40. Typically, the manifolds are positioned peripherally in a fashion similar to the illustrated exhaust ducts 44. The cross-section of the manifolds are shown outside the furnace shell 12 in FIG. 8. The heat exchanger system 10 produces a more efficient operation and prolongs the operation life of the EAF furnace 10. In one illustrative embodiment, the panels 40 are assembled such that the sinuously winding piping has a generally horizontal orientation, comparable to the smoke ring illustrated in FIGS. 2-4. The piping 50 can be linked with a linkage 82, as shown in FIG. 7, or can have a base 92 that is mounted to the wall 94. Typically, with the latter configuration the piping has elongate ridges 96 for collecting slag and adding additional surface area to the piping. Alternatively, the panels 40 are mounted such that the sinuously winding piping 50 has a generally vertical orientation as shown in FIG. 5. The upper ends of the panels 40 define a circular rim at the upper margin of the side wall 26 portion of the furnace 80.

The heat exchanger system 10 can be fitted to the roof 32 of the furnace 80, wherein the water cooled panels 40 have a curvature that substantially follows the domed contour of the roof 32. The heat exchanger system 10, illustratively, is deployed on the inside of side wall 26 of the furnace 80, the roof 32 and the entrance of the exhaust system 16, as well as the throughout the exhaust system 16. Cumulatively, the heat exchanger system protects the furnace and cools the hot waste gasses 36 as they are ducted to a bag house or other filtering and air treatment facilities, where dust is collected and the gasses are vented to the atmosphere.

In operation, hot waste gasses 36, dust and fumes are removed from the hearth 24 through vent 46 in the furnace shell 12. The vent 46 communicates with the exhaust system 16 comprised of the fume ducts 44, as shown in FIGS. 1 and 1*a*-1*d*.

Referring to FIG. 5, the panel 40 has multiple axially arranged pipes 50. U-shaped elbows 53 connect adjacent sectional lengths of piping or pipes 50 together to form a continuous piping system. Linkages 82 that additionally serve as spacers are between adjacent pipes 50, and they provide structural integrity of the panel 40 and are determinative of curvature to the panel 40.

FIG. 7 is a cross-sectional view of the panel embodiment of FIG. 5. A variation is illustrated in FIG. 6, wherein the pipes 50 have a tubular cross-section, a base 92, an elongate ridge 96, and a base plate 93. The base plate 93 is attached to the furnace wall 26, or to the furnace roof 32. The combination of the piping and, optionally, the base plate forms panel 40, which creates an interior wall of the furnace. The panels 40 illustratively cool the wall 26 of the furnace above the hearth in an EAF or the hood and fume ducts of a BOF.

The panels are water cooled, and may be comprised of any suitable material or combination of materials as described herein above including for example and without limitation an aluminum bronze alloy that is custom melted and processed into a seamless pipe 50. For example and without limitation the outer tube 250 may comprise aluminum-bronze while the inner tube 150 may comprise a different grade or thickness of aluminum-bronze or a different material altogether. The cooling ducts 44 are incorporated into the exhaust system 16. Moreover, the piping 50 is formed into the cooling panels 40 and placed throughout the roof 32 and ducts 44. The aluminum bronze alloy desirably has a nominal composition of: 6.5% Al, 2.5% Fe, 0.25% Sn, 0.5% max other, and Cu equaling the balance. However, it will be appreciated that the composition may vary, so that the Al content is at least 5% and no more than 11% with the respective remainder comprising the bronze compound.

The use of the aluminum bronze alloy, for example and without limitation as the outer cladding material 250, provides enhanced mechanical and physical properties over prior art devices (i.e., carbon or stainless steel cooling systems) in that the alloy provides superior thermal conductivity, hardness, and modulus of elasticity for the purposes of steel making in a furnace. By employing these enhancements, the operational life of the furnace is directly increased.

In addition to the superior heat transfer characteristics, the elongation capabilities of the alloy is greater than that of steel or stainless steel, thereby allowing the piping and duct work 44 to expand and contract without cracking. Further, the surface hardness is superior over the prior art in that it reduces the effects of erosion from the sand blasting effect of off-gas debris.

In the pipes shown in FIG. 6, the elongate ridge 96 is a fin or spline that is especially suitable for collecting slag. The mass on each side of the centerline of the tubular section is illustratively and generally equivalent, so that the mass of the elongate ridge 96 is approximately equal to the mass of the base 92. By balancing the mass and employing extruded aluminum bronze alloys, the resulting pipe is substantially free of stress risers. The disclosed pipe has improved stress characteristics, and heat exchange panels fabricated with these pipes are less subject to damage caused by dramatic temperature changes, for instance, during the cycling of the furnace.

The composition of the illustrative heat exchanger system (s) differs from the prior art in that piping and plates in the prior art were composed of a single material such as carbon-steel or stainless steel or aluminum bronze alloy, as opposed to a combination of materials such as for example and without limitation carbon-steel, stainless steel, and/or aluminum bronze alloy. As noted, the use of aluminum-bronze for the outer tube 250 offers several advantages over other materials. For example and without limitation, the composition of the aluminum bronze alloy is not as prone to acid attack. Furthermore, it has been determined that aluminum bronze has a higher heat transfer rate than both carbon-steel or stainless steel, and that the alloy possesses the capability to expand and contract without cracking. Also, the surface hardness of the alloy is greater than that of either steel, thereby reducing the effects of eroding the surface from the sand blasting effects of the exhaust gas moving through the duct/cooling system.

Figure 9:
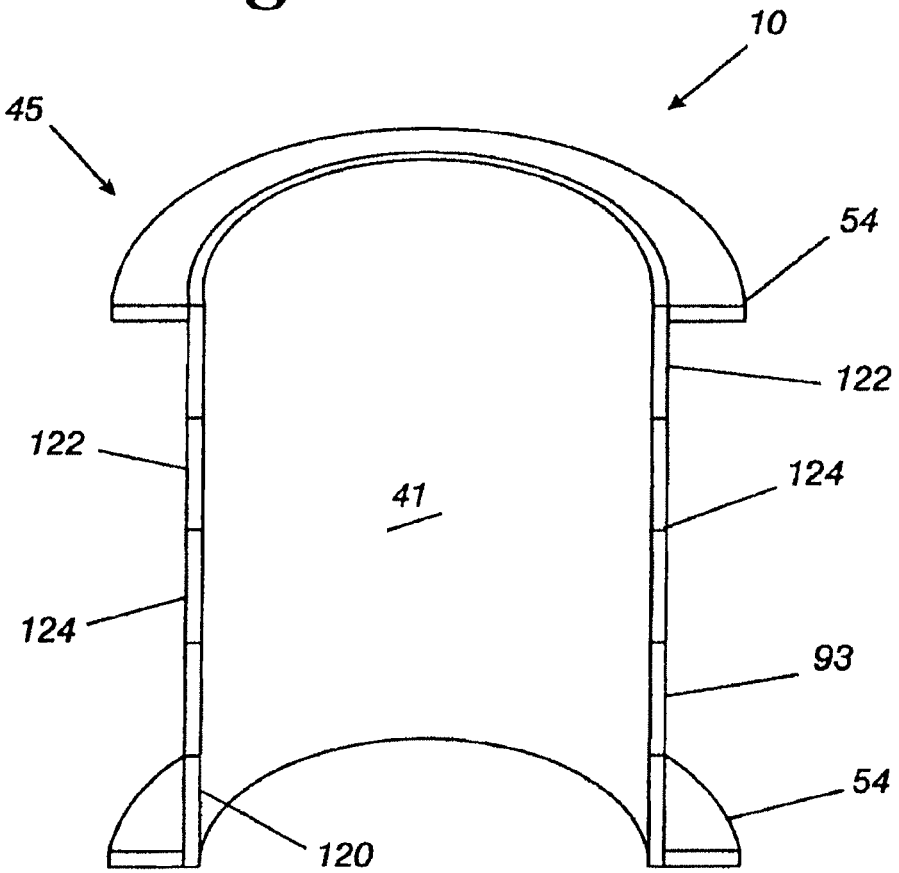
FIG. 9 is a cross-sectional view of a heat exchange system that utilizes baffles, where the system provides cooling for a duct. The system has a channel created by the baffles, where the baffles direct the flow of the cooling fluid to flow in a serpentine fashion.

In another illustrative embodiment, a similar flow of the cooling fluid through the heat exchanger system is achieved through the use of a sinuously winding channel. The channel 122 is formed by interspacing baffles 124 between a front plate 120 and the base plate 93. FIG. 9 illustrates an embodiment of the heat exchanger system 10 using baffles. In the illustrated embodiment, the heat exchanger system 10 is a duct 45, where the front plate 120 is on the interior of the duct 45. In the illustrated embodiment, the base plate 93 also functions as the exterior wall of the duct 45. The duct has flanges 54 for coupling one duct to another duct, or coupling to an air box 48, or coupling to the roof 32 of the furnace 80. In the illustrated embodiment the cooling fluid flows in and out of the plane of the paper. As illustrated, there is only one panel 41, and it is in fluid communication with an input manifold (not shown) and an output manifold (not shown). The manifolds are mounted to the exterior side of the base plate 93.

Figure 10:
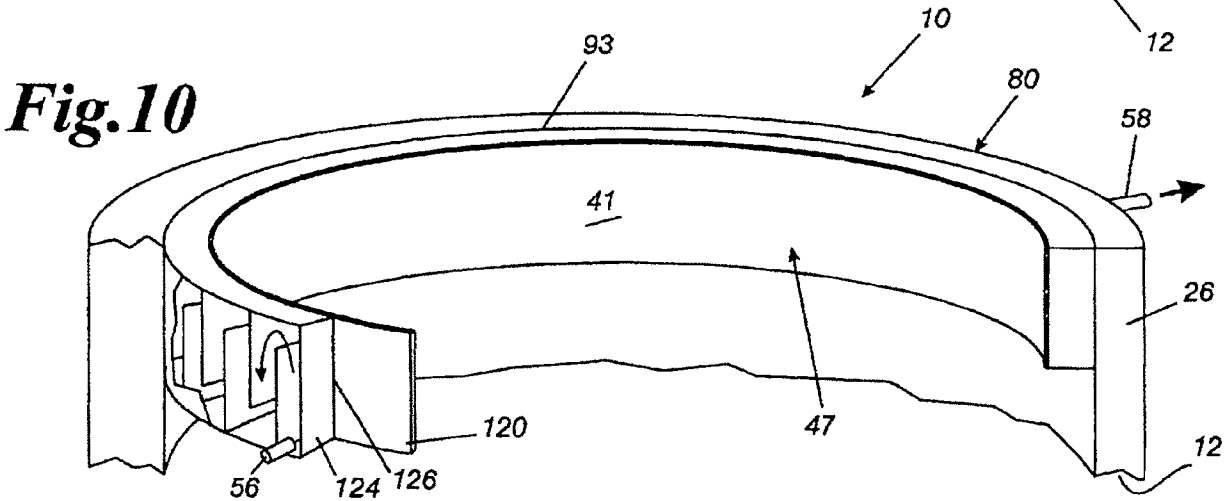
FIG. 10 is a partially cutaway cross-sectional side view of a heat exchange system that utilizes baffles, where the heat exchanger is fitted on the wall of a steel making furnace. The heat exchanger has an aluminum bronze front plate, baffles, and base plate. The front plate is directly exposed to the heat, exhaust gasses, and slag produced by the furnace.

FIG. 10 illustrates the heat exchanger system 10 configured as an interior furnace wall 47, which is cooling panel 41. The interior furnace wall 47 is fabricated to follow the contour of the wall 26 of the furnace shell 12. The panel 41 has baffles 124 mounted between the front plate 120 and the base plate 93. The system has an inlet 56 and an outlet 58 for the cooling fluid. The manifolds, which supply cool water and a return, are in fluid communication with the panel 41. Although only one panel is shown, the application could be configured to have multiple panels. The front plate 120 and the baffles 124 illustratively have an aluminum bronze alloy composition. The baffles illustratively are welded to the front plate along longitudinal edge 126. The base plate is attached to the opposing longitudinal edge, therein forming the channel 122. The channel 122 can be seen on the left hand side corner of FIG. 10. Note, the flow of the cooling fluid is sinuously winding in a serpentine fashion, very similar to the flow through the assemblage of pipes mounted side-by-side, as shown in FIG. 5. The manifolds are not shown in embodiment 45 or 47, but are positioned peripherally, as previously illustrated in FIG. 2.

Figure 11:
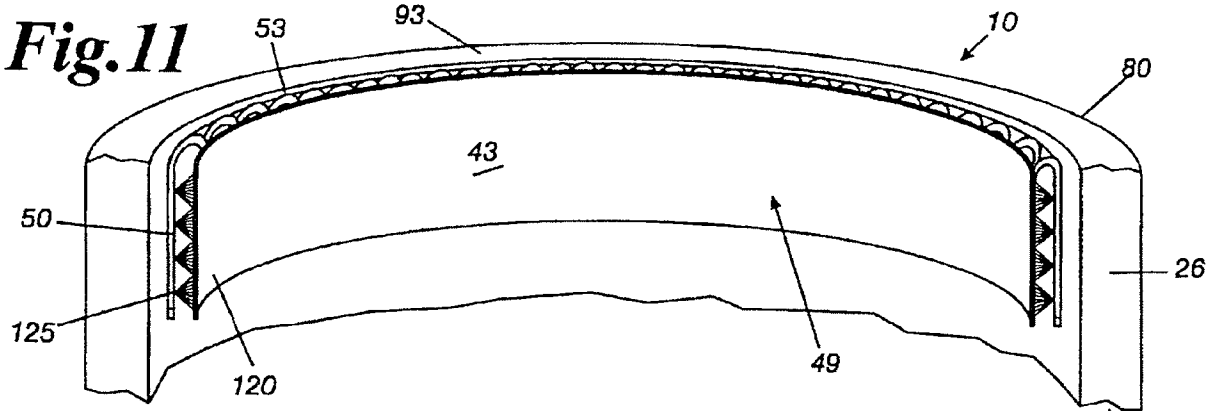
FIG. 11 is a cross-sectional view of a heat exchange system that utilizes spray nozzles, where the heat exchanger is fitted on the wall of a steel making furnace. The heat exchanger has an aluminum bronze front plate, pipes illustratively having an outer material that differs from an inner material and fitted with nozzles, and a base plate. The front plate is directly exposed to the heat, exhaust gasses and slag produced by the steel making process. The nozzles spray the cooling fluid from the base plate toward the backside of the front plate. The front plate is displaced sufficiently from the nozzles that the cooling fluid is dispersed over a wider area.

Referring to FIG. 11, which illustrates an interior furnace wall 49 cooled with a panel 43 having a plurality of spray nozzles 125. The heat exchanger has an aluminum bronze front plate 120, pipes 50 fitted with nozzles 125 and a base plate 93. The front plate 120 is directly exposed to the heat, exhaust gasses, and slag produced by the steel making process. The nozzles 125 spray the cooling fluid from the base plate toward the backside of the front plate 120.

Figure 12:
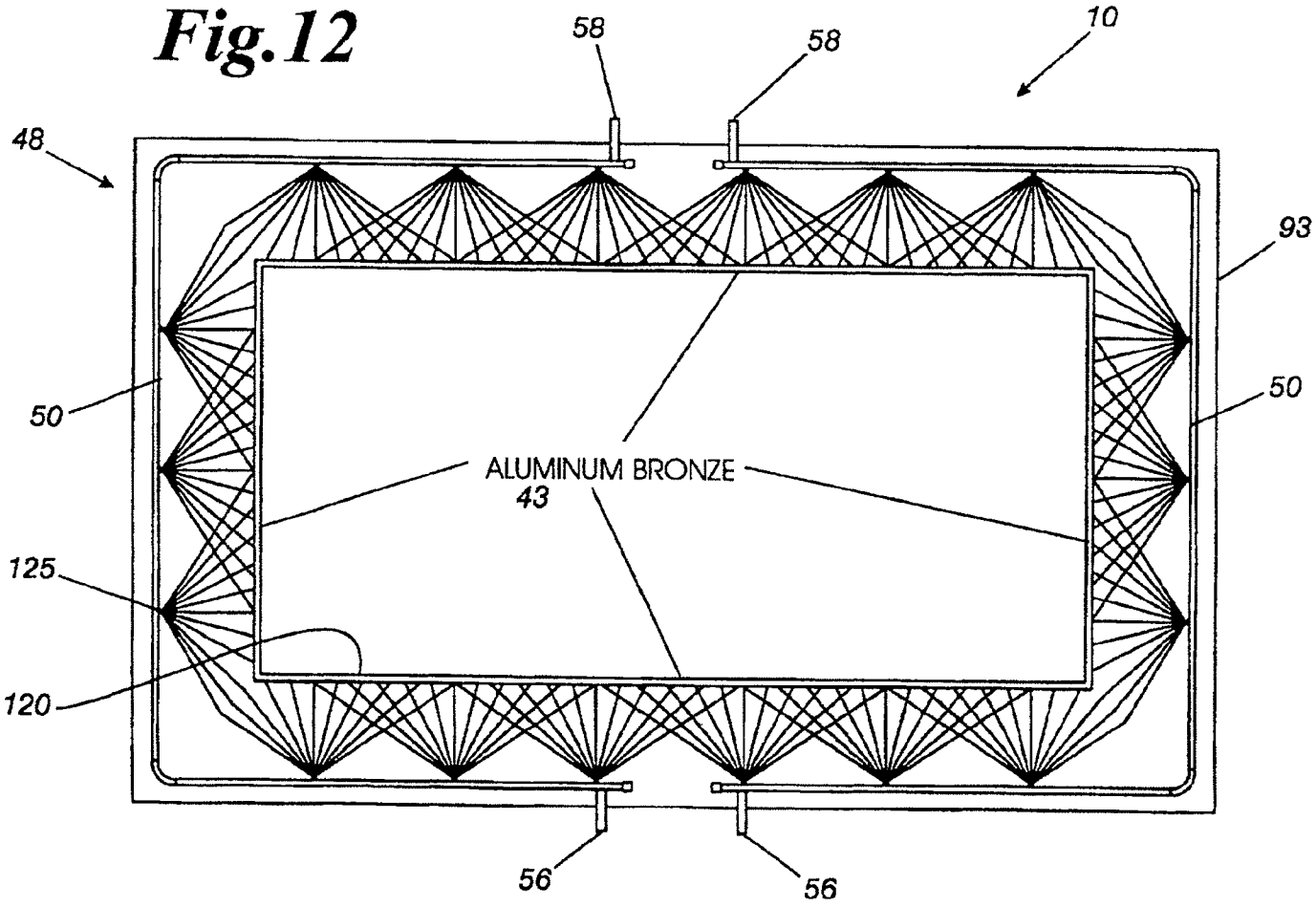
FIG. 12 is a cross-sectional view of a heat exchanger system that utilizes spray nozzles, where the heat exchanger is an air box. The aluminum bronze front plate is on the interior of the air box, and pipes illustratively having an outer material that differs from an inner and fitted with nozzles, are mounted to the base plate. The nozzles spray the cooling fluid from pipes secured to the base plate toward the backside of the front plate. The front plate is displaced sufficiently from the nozzles that the cooling fluid is sprayed in an overlapping pattern. The overlap is sufficient to cover an area. Note, there are two inlets and two outlets.

Referring to FIG. 12, which is a cross-sectional view of an air box 48 that is cooled using a heat exchanger system that utilizes spray nozzles 125. The illustrative four aluminum bronze front plates 120 define the interior of the air box 48. The plurality of nozzles 125 on pipe 50, direct a pattern spray of cooling fluid to the back side of the front plate 120. The base plate 93 serves as a mount for the illustrative pipes 50 as well as an exterior wall for the air box 48. The front plate 120 is displaced sufficiently from the plurality of nozzles that the cooling fluid is sprayed in an overlapping pattern. The overlap is sufficient to cover an area, which reduces the number of serpentine windings necessary to cool the front plate. In the illustrated embodiment shown in FIG. 12 there is an assemblage of only two pipes shown, each with an inlet 56 and an outlet 58. Not shown could be many more pipes with nozzles. Reviewing FIG. 11, the pipes are connected with U shaped elbows 53, and similar connections can be used in the air box 48. As illustrated, there is only one panel 43 having at least one inlet and outlet.

It will be appreciated that other types of tubes/pipes fall within the scope of the disclosure. For example, while the outer tube section have an exterior surface or outer boundary 252 that is completely arcuate and generally uninterrupted or smooth, it may also have portions, for example and without limitation that may be generally planar, for example base 92, or may have protrusions. The protrusions may comprise the previously described fins or splines 96, they may also comprise horizontally extending planar portions or wings extending from the base. Alternatively the planar portions may define notches or indentations or any other suitable surface depending on the need to optimize or discourage any type of operating characteristic for example and without limitation the need to promote or deter the retention of any foreign material including for example slag or siliceous. Illustratively, the notches or indentions can be for example and without limitation steeped, rectangular, serrated, oval, etc. The thickness of the exposed smooth/indented surface of the pipe(s) 50 may be designed to optimize the heat transfer and mechanical requirements of the process. The support portion of the pipe(s) 50 illustratively may have any suitable geometric configuration including for example and without limitation round, square or obround or otherwise. The tubes/pipe can have any fluid, including for example and without limitation, a liquid such as for example water, or a gas such as for example air directed or flowing through them to create a heat transfer and cooling of the equipment, if needed by the process.

No matter the type of pipe(s) 50, one or more pipe, for example, arcuate, splined, planar, and/or notched, may be coupled together in any combination with one or more of any other type of pipe 50 for example arcuate, splined, planar, and/or notched. For example and without limitation the illustrative pipes 50, alone or coupled together in any combination of smooth, splined, arcuate, indented, notched, winged or other type of pipe, may be coupled with or mounted within the operating portion or area of a metal processing apparatus, system, or equipment including attachment to the system's roof, sidewall, duct, burner gland or other equipment or areas required for metallic melting and refining in for example and without limitation an electric arc furnace (EAF), a foundry furnace, a metallurgical furnace, a ladle metallurgy device, and/or a degassing (VAD AOD, etc) device. The pipe(s) illustratively may be positioned in the equipment between an interior and a wall of the system. In other words, the conduction portion of the pipe is exposed to the hot metal or gases emanating therefrom while the support portion is attached directly to the wall, roof or other interior structure of the system or to a plate that is attached to the system. The support portion may be attached or coupled to the system directly, or it may be attached to a mounting plate or other suitable component, which in turn mounts or couples with a wall, roof, or the like of the system such as for example and without limitation an EAF. The pipes 50 may be coupled using any suitable method including spot welding on either or both sides of the conduction portions, or other suitable methods known to those skilled in the art. Similarly, the support sections can be attached or coupled to the system's support structure or to the plate using any suitable method, including for example and without limitation welding. Any suitable fluid, such as for example and without limitation any gas or liquid, may be directed through the core 200 in order to facilitate heat transfer.

Illustratively, the pipes 50 may be manufactured using any suitable process including being cold rolled, hot rolled, drawn, extruded or cast. Illustratively, the pipes can be manufactured from ferrous metals, steel, copper, steel/ferrous alloy or copper alloys, nickel, titanium, bronze alloys including aluminum-bronze and nickel-bronze alloy alloys, and other suitable materials and combinations thereof. The pipes can be seamless or welded in design. Illustratively, for example if the pipes are extruded, the mass on either side of center line is substantially equal.

From the foregoing, it is readily apparent that we have invented an improved heat exchanger system constructed of aluminum bronze alloys, where aluminum bronze alloys have been found to have a higher than expected thermal conductivity, resistance to etching by the stream of hot gasses, and good resistance to oxidation. Furthermore, we have provided a heat exchanger system wherein the operational life of the heat exchanger is extended, as corrosion, and erosion of the heat exchanger, and related components is reduced when they are fabricated with aluminum bronze alloy.

Additionally, this disclosure introduces a heat exchanger system that is adaptable for cooling exhaust gasses emanating from a steel making furnace, wherein the heat exchanger system can be fitted to the walls of the furnace, a furnace roof, a smoke ring exhaust port, a straight section of an exhaust duct, and a curved section of an exhaust duct. The heat exchanger system cools the exhaust gasses exiting a metallurgical furnace such as EAF or BOF from 4,000° F.-5,000° F. to 200° F.-350° F.

The disclosure provides a heat exchanger system that can be adapted for collecting and cooling slag, where the sinuously winding piping is extruded seamless piping having an elongate ridge, and the piping resists corrosion, erosion, pressure, and thermal stress.

Also provided is a heat exchanger that has other applications, such as cooling exhaust gasses from converting plants, paper manufacturing plants, coal and gas fired electrical power generation plants, and other exhaust gas generators, where the gasses are cooled for the purpose of capturing one or more components of the gas, where capture is effected by condensation, by carbon bed absorption, or by filtration.

It is to be understood that the foregoing description and specific embodiments are merely illustrative of the best mode of the disclosure and the principles thereof, and that various modifications and additions may be made to the apparatus by those skilled in the art, without departing from the spirit and scope of this disclosure.

While the disclosure has been illustrated and described in detail in the foregoing drawings and description, the same is to be considered as illustrative and not restrictive in character, it being understood that only illustrative embodiments thereof have been shown and described and that all changes and modifications that come within the spirit of the disclosure are desired to be protected.

What is claimed is:

1. A heat exchange apparatus configured to cool exhaust gases emanating from a furnace, comprising:

a mounting member adapted to be coupled to a furnace; and a first half pipe and a second half pipe, wherein first half pipe and the second half pipe are coupled to the mounting member and each comprise an inner tube including a passageway formed in the inner tube, the passageway facilitating flow of a cooling fluid through the inner tube and an outer tube overlaying and contacting the inner tube, wherein the first half pipe and the second half pipe are each adapted to be located inside the furnace and the outer tube is exposed to and faces an interior of the furnace;

wherein the first half pipe includes a bisected cylindrical body and first and second mounting ends coupled thereto and the second half pipe includes a bisected cylindrical body and first and second mounting ends coupled thereto;

wherein the shape of each first and second mounting end deviates from the shape of the respective bisected cylindrical body coupled thereto;

wherein a single weld couples the second mounting end of the first half pipe and the first mounting end of the second half pipe to the mounting member;

wherein, the outer tube is adapted to contact and withstand a corrosive gas from the furnace having a temperature exceeding 4000° F.;

wherein, the inner tube and the outer tube are coaxial and coextensive with one another;

wherein, the inner tube is manufactured from a first selected material and the outer tube is manufactured from a second selected material;

further wherein, the heat exchange apparatus is configured to cool the corrosive gas from a temperature exceeding 4000° F. to a temperature between 200-350° F.

2. The heat exchange apparatus of claim 1, wherein the first selected material is selected from the list consisting of a ferrous metal, steel, copper, aluminum, a steel ferrous alloy, a copper alloy, nickel, titanium, a bronze alloy, an aluminum-bronze alloy, and a nickel-bronze alloy and the second selected material is selected from the list consisting of a ferrous metal, steel, copper, aluminum, a steel ferrous alloy, a copper alloy, nickel, titanium, a bronze alloy, an aluminum-bronze alloy, and a nickel-bronze alloy.

3. The heat exchange apparatus of claim 1, wherein the outer tube is extruded onto the inner tube.

4. The heat exchange apparatus of claim 1, wherein the first and second half pipe cooperate to form at least one panel of a sinuously winding pipe having an inlet, an outlet, an input manifold in fluid communication with the inlet, and an output manifold in fluid communication with the outlet.

5. The heat exchange apparatus of claim 1, wherein the outer tube is formed from a material consisting of an aluminum bronze alloy having a composition of at least 5% aluminum and no more than 11% aluminum.

6. The heat exchange apparatus of claim 5, wherein the outer tube is formed from a material having a composition of at least 89% copper and no more than 95% copper.

7. The heat exchange apparatus of claim 1, wherein the structure of the inner tube and the outer tube differ from one another.

8. The heat exchange apparatus of claim 1, wherein the first selected material comprises aluminum bronze that differs from a grade of the second selected material.

9. The heat exchange apparatus of claim 1, wherein the inner tube is defined by a first inner boundary and a first outer boundary; and the outer tube is defined by a second inner boundary and a second outer boundary, the second inner boundary overlaying the first outer boundary.

10. The heat exchange apparatus of claim 9, wherein the second outer boundary includes one or more elongate ridges.

11. The heat exchange apparatus of claim 9, wherein the second outer boundary includes a generally planar portion having a notch therein.

12. A heat exchange apparatus for use in an environment having hot corrosive gases, the heat exchange apparatus comprising:

a mounting member; and a plurality of half pipes, each of the plurality of half pipes approximating a bisected geometric body and including opposed mounting ends, the opposed mounting ends having a shape deviating from the shape approximating the bisected geometric body;

wherein the mounting ends of adjacent half pipes of the plurality of half pipes are joined to the mounting member by a single weld;

wherein each half pipe comprises an inner tube including a passageway formed within the inner tube, the passageway facilitating flow of a cooling fluid through the inner tube and an outer tube extruding onto the inner tube as a covering layer so as to overlay and contact the inner tube, such that the extruding enables the outer tube to be in contact with and withstand the hot corrosive gases at temperatures greater than 4000° F.;

wherein the inner tube and the outer tube are coaxial, and are fixed from movement relative to each other;

wherein the inner tube is manufactured from a first selected material and the outer tube is manufactured from a second selected material different from the first selected material.

13. The heat exchange apparatus of claim 12, wherein the first selected material is selected from the list consisting of a ferrous metal, steel, copper, aluminum, a steel ferrous alloy, a copper alloy, nickel, titanium, a bronze alloy, an aluminum-bronze alloy, and a nickel-bronze alloy and the second selected material is selected from the list consisting of a ferrous metal, steel, copper, aluminum, a steel ferrous alloy, a copper alloy, nickel, titanium, a bronze alloy, an aluminum-bronze alloy, and a nickel-bronze alloy.

14. The heat exchange apparatus of claim 12, wherein the plurality of half pipes form at least one panel of a sinuously winding pipe having an inlet, an outlet, an input manifold in fluid communication with the inlet, and an output manifold in fluid communication with the outlet.

15. A heat exchange system, comprising:

a furnace having means for heating an interior of the furnace and generating exhaust gases in the temperature range of about 4000° F. to 5000° F.;

a panel of sinuously winding piping having an inlet and an outlet;

a mounting member coupled to the furnace and the panel of sinuously winding piping;

an input manifold in fluid communication with the inlet of the panel;

an output manifold in fluid communication with the outlet of the panel;

the piping comprising of plurality of half pipes, each of the plurality of half pipes approximating a bisected geometric body and including opposed mounting ends, the opposed mounting ends having a shape deviating from the shape approximating the bisected geometric body;

the piping comprising an inner tube manufactured from a first selected material and an outer tube manufactured from a second selected material, the outer tube being co-extruded together with the inner tube such that the outer tube overlays and contacts the inner tube;

the piping being configured to have a cooling fluid flowing through a passageway formed by the inner tube;

the piping being located in the furnace to have a stream of the exhaust gases from the furnace flowing over the outer tube such that the outer tube is adapted to contact and withstand the stream of exhaust gases flowing over it;

wherein, the inner tube and the outer tube are coaxial and coextensive with one another;

wherein, the sinuously winding piping is an assembly of sectional lengths of connected half pipes mounted side-by-side and the mounting ends of adjacent half pipes of the plurality of half pipes are joined to the mounting member by a single weld.

* * * * *